United States Patent [19]

Pitsch

[11] Patent Number: 4,679,880

[45] Date of Patent: Jul. 14, 1987

[54] STRAIN RELIEF ATTACHMENT FOR WIRE CONNECTOR ASSEMBLY

[75] Inventor: Daniel M. Pitsch, Minneapolis, Minn.

[73] Assignee: ADC Telecommunications, Inc., Minneapolis, Minn.

[21] Appl. No.: 809,574

[22] Filed: Dec. 16, 1985

[51] Int. Cl.[4] ..... H01R 4/24

[52] U.S. Cl. ..... 439/404

[58] Field of Search ..... 339/97 R, 97 P, 98, 339/99 R

[56] References Cited

U.S. PATENT DOCUMENTS 3,958,853 5/1976 Wilson ..... 339/99 R 4,068,912 1/1978 Hudson, Jr. et al. ..... 339/99 R

*Primary Examiner*—Joseph H. McGlynn

*Attorney, Agent, or Firm*—Merchant, Gould, Smith, Edell, Welter & Schmidt

[57] ABSTRACT

A strain relief attachment is disclosed for a wire connector assembly where the wire connector assembly has a wire attaching side with a plurality of insulation displacement connectors. The strain relief attachment includes a body member having a common restraining edge and is secured to the wire connector assembly with the common restraining edge disposed in overlying spaced relation to the insulation displacement connectors. A plurality of individual restraining members are secured to the body member and extend therefrom with each of the members extending between individual insulation displacement connectors to provide a passage for an individual wire to extend from the connector through opposing individual restraining members.

5 Claims, 12 Drawing Figures

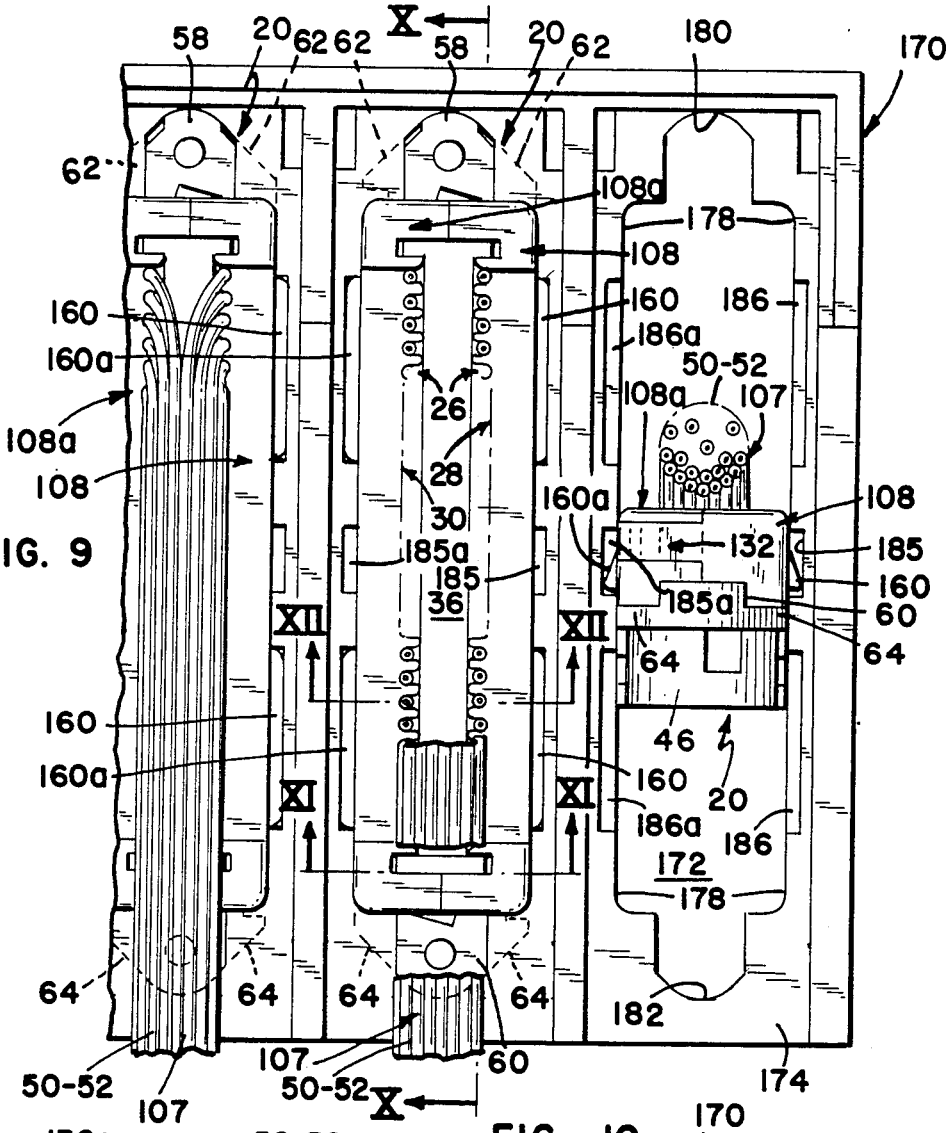
FIG. 9
FIG. 10
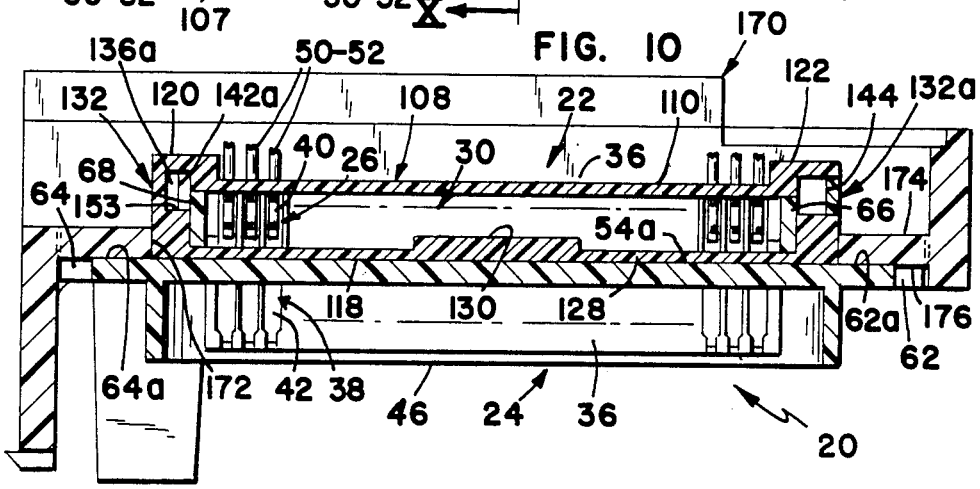

STRAIN RELIEF ATTACHMENT FOR WIRE CONNECTOR ASSEMBLY

BACKGROUND OF THE INVENTION

I. Field of the Invention

This invention pertains to wire connector assemblies. More particularly, this invention pertains to strain relief attachments for such wire connector assemblies.

II. Description of the Prior Art

In the prior art, wire connector assemblies are widely used to modularly connect a wire cable to a piece of equipment or to another cable. Such connector assemblies consist of two sides including a wire attaching side and a terminal mating side.

A commonly available wire connector assembly is marketed under the name CHAMP and manufactured by the AMP Corporation of Harrisburg, Pa. In this connector, the wire attaching side includes two parallel rows of insulation displacement connectors. Each of the insulation displacement connectors has a slot which is perpendicular to the rows and contains an electrically conductive insulation piercing member which projects into the slot. When an insulation bearing conductive wire is inserted into the slot, the insulation piercing members pierce the insulation and contact the wire conductor to provide good electrical and mechanical connection between the wire and the insulation displacement connectors. The insulation displacement connectors hold the inserted wires with the wire axes perpendicular to the rows to provide two rows of parallel linearly aligned wires. The terminal mating side of the conductor is provided with either a male or female configuration for receiving a terminal to connect the wire connector assembly with a piece of equipment or to splice with another cable.

In wire connector assemblies as described above, the wire is mechanically held within the assembly by reason of the contact between the knife edges of the insulation piercing members and the conductive wire. If the wire were to be moved, it will bend at the point of contact between the wire and the insulation displacement connectors. When this happens, the wire can become cold worked and break. To avoid this problem, the prior art has developed strain relief attachments for such wire connector assemblies. Such strain relief attachments include body members which are secured to the wire connector assembly and present restraining edges which are disposed opposing the wires and displaced spaced from the insulation displacement connectors. As a result of this configuration, when a wire is bent transversely to the longitudinal direction of the insulation displacement connector rows, the conductor will bend at a location opposing a restraining edge. At this location, the insulation is still in contact and there is no sharp bend made on the conductive wire. As a result, wire failure is abated. The restraining edge also acts to hold the wire within the insulation displacement connector.

Notwithstanding the fact that prior art strain relief attachments have added some protection to wire displacement and breakage, wire connector assemblies with such prior art strain relief attachments still present certain problems which the art has to date been unable to fully rectify. For example, such connectors are still susceptible to wire breakage due to cold working of the wire. Although such occurrences are relatively slight, even an occasional breakage is extremely troublesome since such connectors are used with a substantial number of wires which are not readily identifiable and therefore require a substantial amount of labor time to identify the broken wire and make necessary repairs and replacements. Also, it is possible for foreign conductive material to find its way into the wire connector assembly and possibly create a short across two or more of the insulation displacement connectors. Still another problem associated with such prior art wire connector assemblies is that when a large plurality of wires are connected to the wire attaching side, they may become entangled and jumbled such that the wire connector assembly does not provide an organized appearance which would facilitate wire identification. Finally, such prior art wire connector assemblies are commonly provided with means to mount the assemblies in a mounting bracket. Such assemblies typically provide for mechanisms of mounting which are not conducive to quick installation and occasionally provide for a weak or unstable mount.

SUMMARY OF THE INVENTION

According to a preferred embodiment of the present invention, there is provided a strain relief attachment for a wire connector assembly where the wire connector assembly has a wire attaching side which includes a plurality of insulation displacement connectors. Each of the insulation displacement connectors has a wire receiving slot sized to receive insulation bearing conductive wire of predetermined size. The insulation displacement connectors further have electrically conductive insulation piercing members which project into the slots and are sized to pierce insulations of a wire received within the slot and conductively engage the wire. The plurality of connectors are arranged with their slot axes parallel and linearly aligned to hold a plurality of wires within the slots with the wire axes also parallel and linearly aligned. The strain relief attachment comprises a body member having transverse restraining means for restraining movement of wires transverse to their linear alignment and means for securing the body member to the wire connector assembly with the transverse restraining means disposed spaced from the plurality of connectors by a predetermined distance and in overlying relation to the connectors. A plurality of individual restraining members are secured to the body member and extend therefrom with the individual members extending between each of the insulation displacement connectors.

BRIEF DESCRIPTION OF THE DRAWINGS

FIG. 9 is a view of several wire connector assemblies mounted in a mounting bracket and shown partially in section and further showing a wire connector assembly with a strain relief attachment in the process of being inserted and mounted on the mounting bracket;

FIG. 10 is a view taken along line X—X of FIG. 9;

DESCRIPTION OF THE PREFERRED EMBODIMENT

Referring to the Figures, the prior art strain relief attachments and the strain relief attachment of the present invention are shown with respect to their incorporation and use with a particular wire connector assembly 20. The wire connector assembly 20 shown in all of the Figures is substantially the same and is preferably an assembly such as that marketed under the trade name CHAMP connector manufactured by the AMP Corporation of Harrisburg, Pa. Such a connector assembly is in wide use today and a description of this particular wire connector assembly 20 will be presented prior to a description of the prior art strain relief attachments or the strain relief attachment of the present invention.

Figure 5:
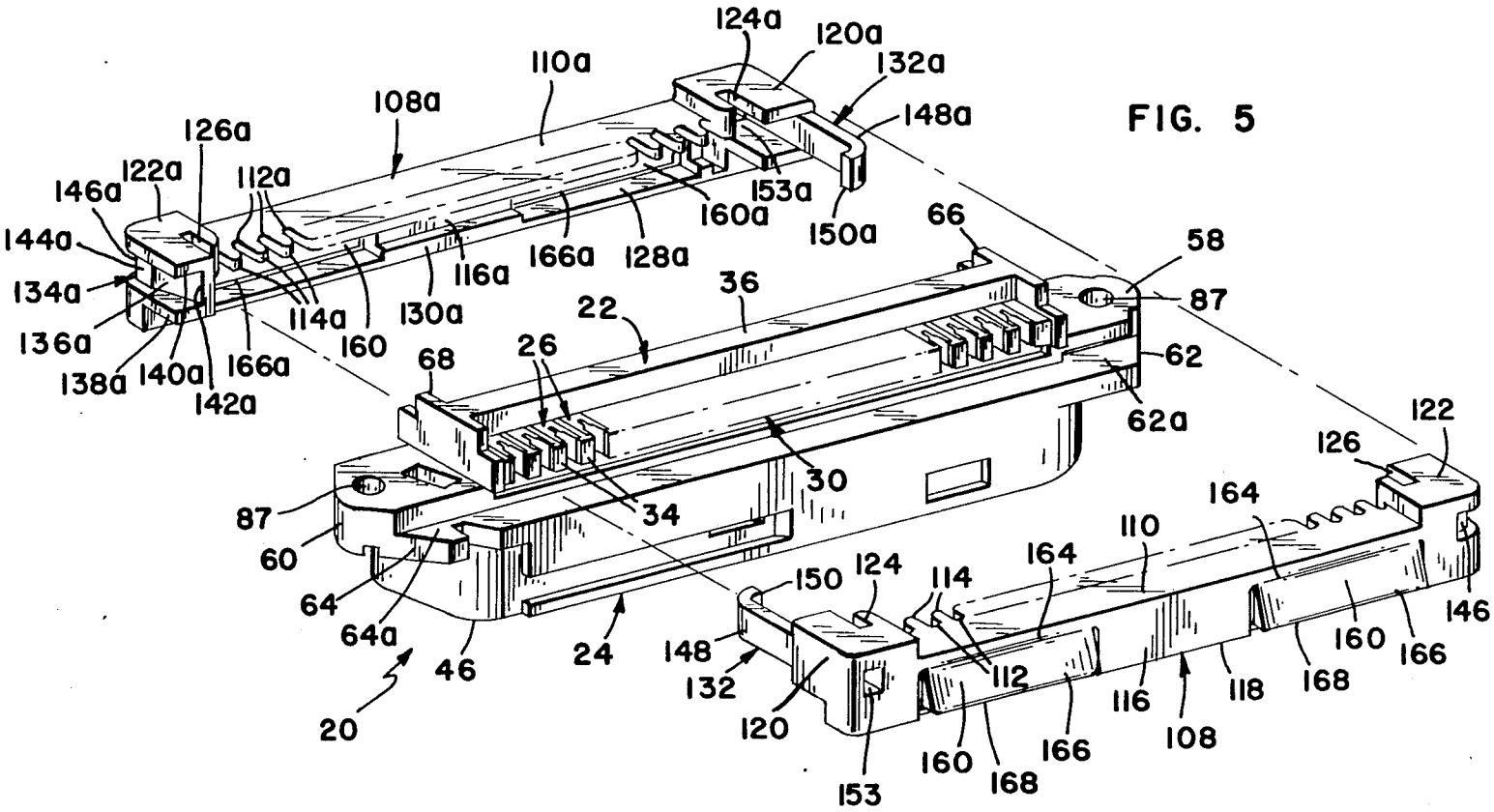
FIG. 5 is a perspective view of a wire connector assembly with a strain relief attachment of the present invention shown in exploded form.
Figure 6:
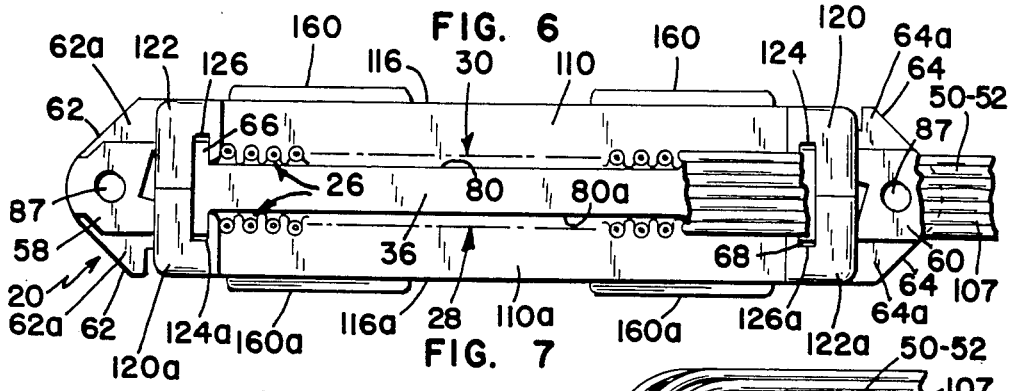
FIG. 6 is a top plan view of a wire connector assembly with a strain relief attachment of the present invention with portions of a wire cable broken away.
Figure 7:
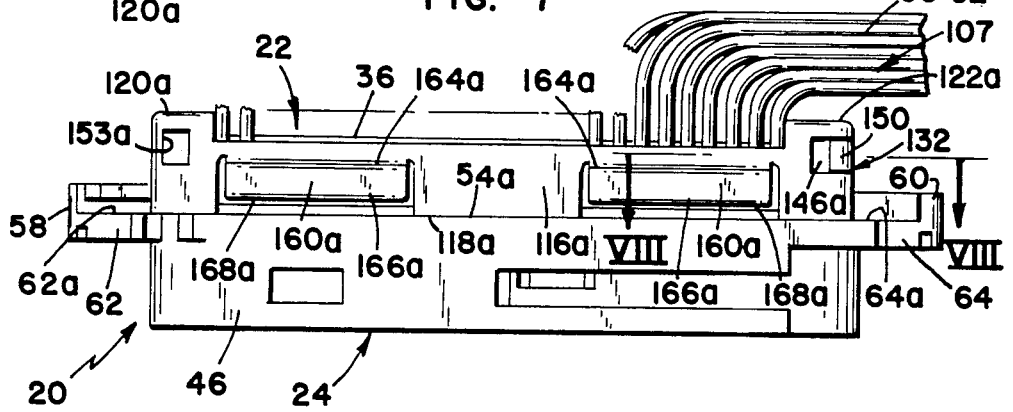
FIG. 7 is an elevation view of a wire connector assembly and relief attachment of FIG. 6.

With reference to FIG. 5, a wire connector assembly 20 is shown in perspective view and includes a first side which is a wire attaching side 22 and a second side which is a terminal mating side 24. The wire attaching side 22 includes a plurality of insulation displacement connectors 26. As shown in the top plan views (such as views 1, 4, 6, 8 and 9) the wire attaching side 22 is symmetrical about an imaginary plane such that the insulation displacement connectors 26 are disposed in two parallel rows including a first set of a plurality of linearly aligned connectors 28 disposed on one side of the imaginary plane and a second set 30 of a plurality of connectors 26 disposed on the opposite side of the imaginary plane (as shown for example in FIGS. 8 and 9).

Figure 8:
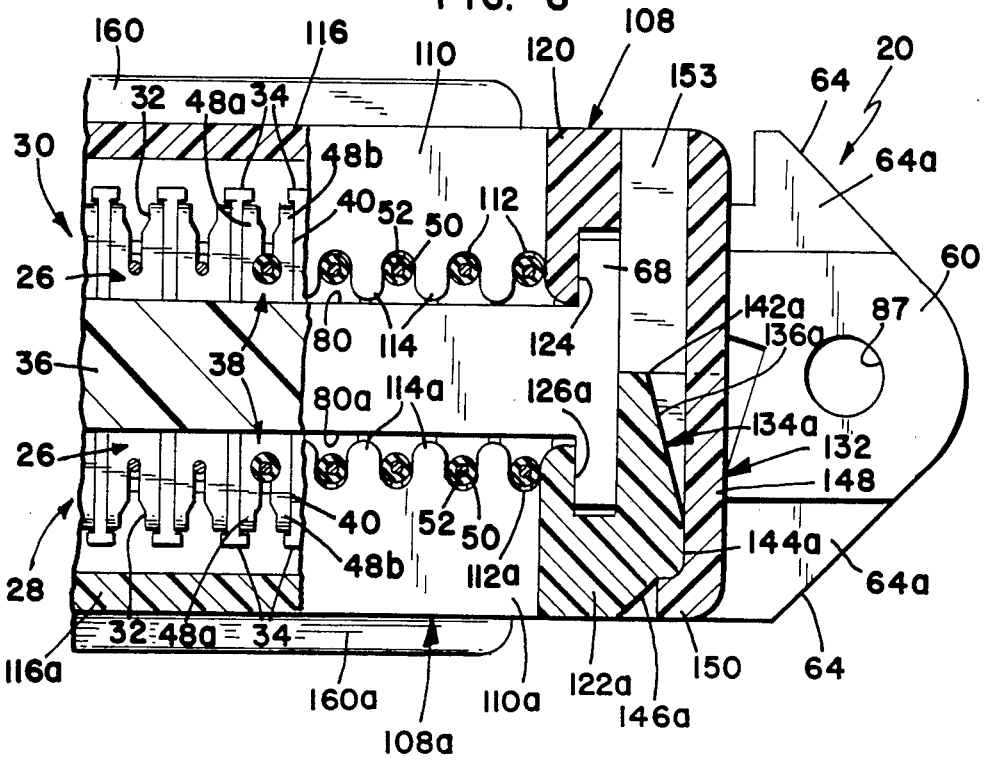
FIG. 8 is a view taken along lines VIII—VIII of FIG. 7.
Figure 11:
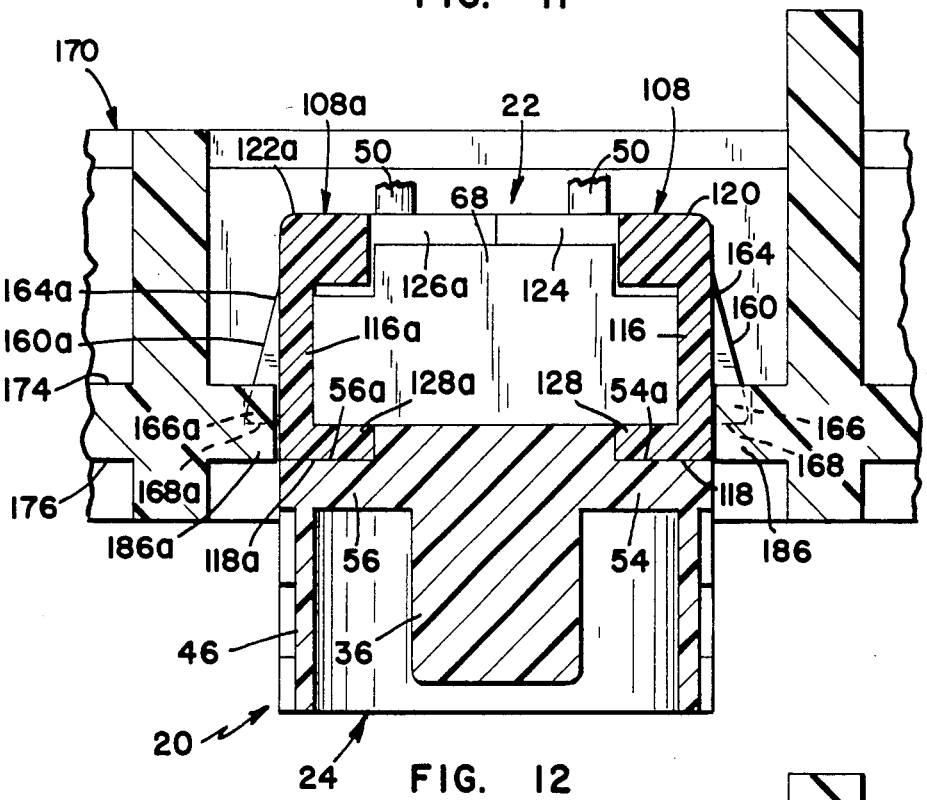
FIG. 11 is a view taken along line XI—XI of FIG. 9.
Figure 12:
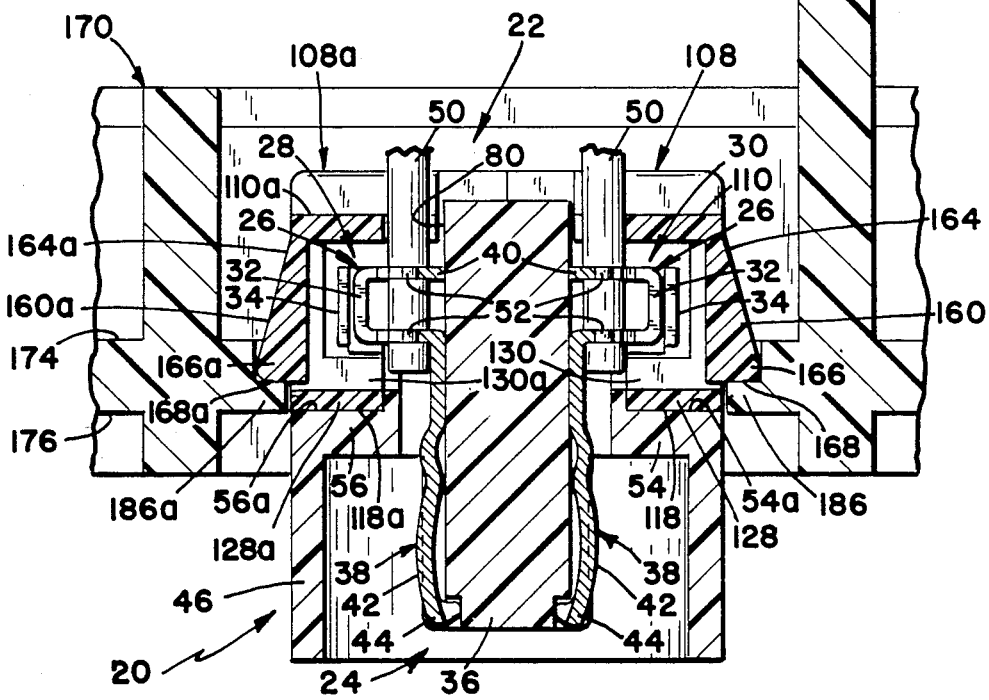
FIG. 12 is a view taken along line XII—XII of FIG. 9.

Best shown in FIGS. 8 and 12, the insulation displacement connectors 26 each include a slot 32 which is defined by the opposing surfaces of nonconductive posts 34 which project perpendicularly from a centrally located nonconducting plate 36 which extends between the first set 28 and second set 30. The insulation displacement connectors 26 include a conductive connector member 38. The conductive connector members 38 are disposed between each of the post 34 and are provided with a wire receiving end 40 disposed between the post 34 and a terminal receiving end 42 which are provided with a clip end 44 engaging an end of the centrally located plate 36 on the terminal mating side 24 of the wire connector assembly 20. As shown in FIG. 12, the terminal receiving ends 42 are disposed along the central plate 36 to provide a male configured terminal mating side 24 which is surrounded by a protective skirt 46 of nonconductive material that is integrally formed with the central plate 36 and post 34.

Best shown in FIG. 8, the wire receiving end 40 of conductive connector members 38 each include a pair of electrically conductive insulation piercing members 48*a* and 48*b* which project from opposing posts 34 into slots 32 and are sized to pierce insulation 50 covering a conductive wire 52. As the piercing members 48*a* and 48*b* pierce the insulation 50, they conductively engage the wire 52 and thereby provide a good mechanical and electrical contact between the conductive connector members 38 and the wires 52.

The plurality of insulation displacement connectors 26 are arranged such that the axes of slots 32 are parallel to one another and linearly aligned and, furthermore, are parallel to the imaginary plane which is coplanar with central plate 36. So arranged, the slots 32 hold the wires with the axes of the wires disposed within the slots of wires in first set 28 being parallel and linearly aligned. Additionally, the wires 52 contained within the second set 30 of the plurality of connectors 26 are also linearly aligned and parallel to one another and to the plane of central plate 36.

As shown in FIG. 12, the skirt 46 is provided with aligned flat plates 54 and 56 which extend generally perpendicular from central plate 36 with the upper surfaces 54*a* and 56*a* of the plates 54 and 56 defining the boundary separation between the wire attaching side 22 and terminal mating side 24 of the wire connector assembly 20. Furthermore, the surfaces 54*a* and 56*a* are spaced from the posts 34 by a predetermined distance.

As best shown in FIGS. 8 and 5, the wire connector assembly 20 is provided longitudinally protruding tabs 58 and 60 at diametrically opposed longitudinal ends of the wire connector assembly 20. The tabs are provided with outwardly projecting wings 62 and 64 which have upper surfaces which are parallel aligned with surfaces 54*a* and 56*a*. As shown in FIG. 5, the central plate 36 terminates at terminal ends of the row of the first set 28 and the row of the second set 30 of the displacement connectors 26. At the terminal ends of the central plate 36, there are provided end plates 66 and 68 which are perpendicular to central plate 36.

Having described the wire connector assembly 20, it will be appreciated that such a wire connector assembly forms no part of the present invention per se and is preferably a wire connector such as a CHAMP connector manufactured by the AMP Corporation.

Figure 1:
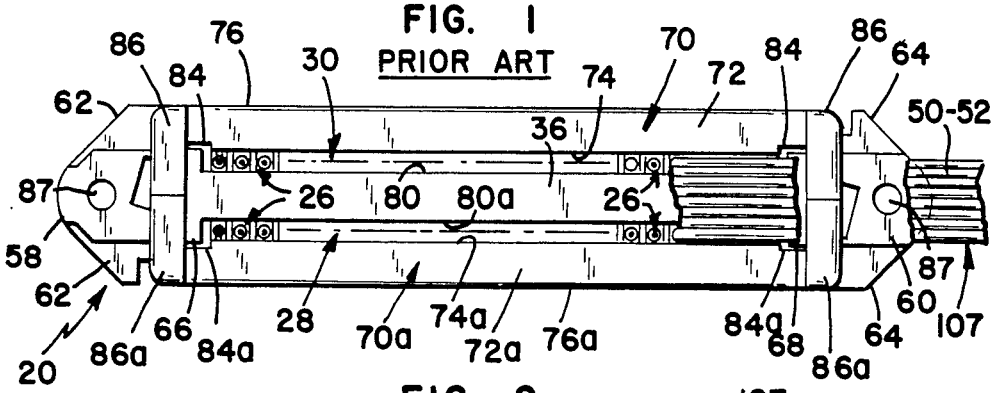
FIG. 1 PRIOR ART
FIG. 1 is a top plan view of a wire connector assembly with a first example of a prior art strain relief attachment.
Figure 2:
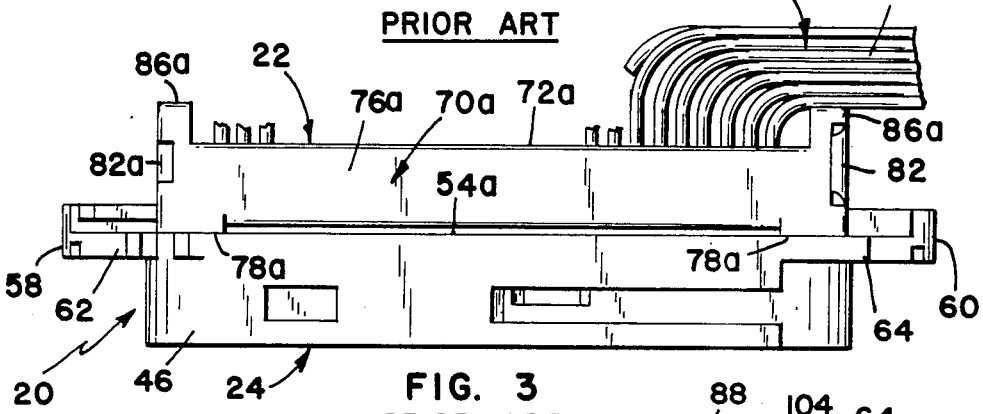
FIG. 2 PRIOR ART
FIG. 2 is an elevation view of a wire connector assembly shown in FIG. 1.

With the wire connector assembly 20 so described, a description of the prior art strain relief attachments may be made with reference to FIGS. 1 through 4. In FIGS. 1 and 2, the first example of a prior art strain relief attachment is shown including a first attachment 70 and a second attachment 70*a*. The first attachment 70 and second attachment 70*a* are identical and a description of one will suffice as a description of the other. Indeed, all of the strain relief attachments described herein, including the strain relief attachment of the present invention, include identical first and second attachments. Accordingly, in each description of the prior art and in the description of the strain relief attachment of the present invention, a detailed description of the structure of the attachments will be made by describing the first attachment of each prior art embodiment and the embodiment of the present invention. Identical parts between first and second attachments will be numbered identically with the addition of "a" added to the numbering of the parts of the second attachments.

As shown in FIG. 1, the strain relief attachment includes a body member 72 which is provided with transverse restraining means for restraining movement of wires transverse to their linear alignment with the means in form of a common restraining edge 74. The body member is secured to the wire connector assembly 20 with the restraining edge 74 opposing wires projecting from the first set 28 of insulation displacement connectors 26. The body member 72 is supported by means of a wall 76 which extends from the body member 72 to a bottom edge 78 abutting and resting on surface 54*a* of plate 54. The body member 72 is supported with the common edge 74 disposed in overlying relation to the insulation displacement connectors 26 and spaced therefrom. The distance between the restraining edge 74 and opposing surface 80 of the central plate 36 (which surface can conveniently be referred to as a fixed restraining surface) is approximately equal to the diameter of an insulation bearing wire. The first attachment 70 and second attachment 70*a* are secured to one another by latch means 82 disposed on longitudinal ends of the strain relief attachments. The latch means 82 include a latch member and a mating member, respectively, disposed on opposite ends of the attachment members with the first attachments latch member engaging the second attachments mating member when the two are disposed on the wire connector assembly 20 as shown in FIGS. 1 and 2. An inwardly projecting flange (not shown) is provided at the edge 78 of the wall 76 and projects toward the center plate 36 and is received between the posts 34 and the surface 54*a*. Also, the attachment members are provided with notches formed therein which notches 84 provide space to accommodate end plates 66 and 68.

With the strain relief attachment so installed, the latching members 82 prevent the first and second attachments 70 and 70*a* from being separated by pulling them apart in a direction transverse with the longitudinal direction shown in FIG. 1. When so connected, the longitudinally displaced end walls 86 of the attachments prevent movement of the latching member in a direction parallel to the longitudinal direction of the wire connector assembly 20. Finally, the inwardly protruding flange (not shown) disposed along face edge 78 and received between the post 34 and surface 54*a* prevents the strain relief attachment from being moved in a direction perpendicular to the longitudinal direction of the wire connector assembly as shown in FIG. 2. As a result, the strain relief attachment is securely received on the wire connector assembly 20.

The wire connector assembly 20 is secured to a bracket by means of bolts or other fastening means received through holes 87 formed in tabs 58 and 60. Alternatively, the wire connector assembly 20 can be placed in a mounting bracket with straps received over the tabs 58 and 60.

A strain relief attachment as described above and shown in FIGS. 1 and 2 is a commercially available item and may be as manufactured by the AMP Corporation and described in their catalog 73-152 revised 5/83 as Catalog Item Number 1-552027-1.

Figure 3:
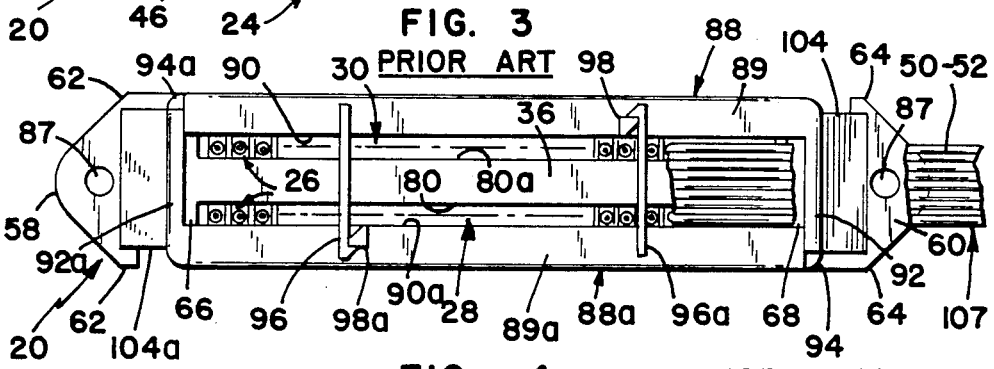
FIG. 3 PRIOR ART
FIG. 3 is a top plan view of a wire connector assembly with a second example of a prior art strain relief attachment.
Figure 4:
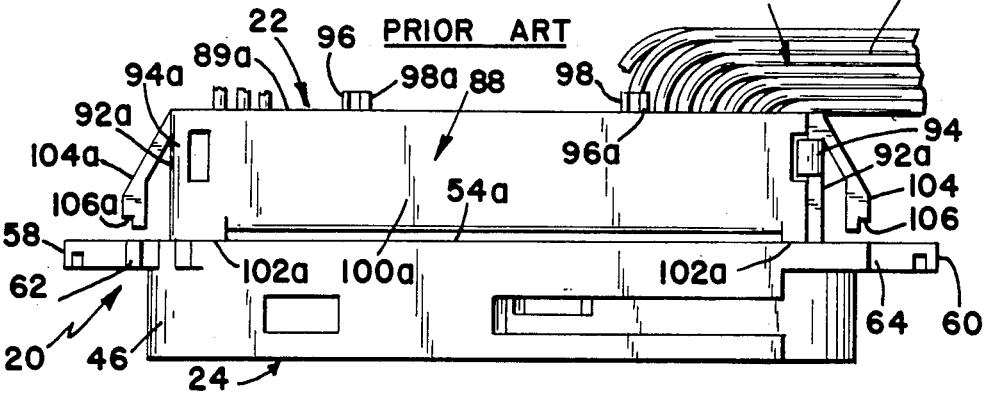
FIG. 4 PRIOR ART
FIG. 4 is an elevation view of the wire connector assembly of FIG. 3.

Referring to FIGS. 3 and 4, a second example of a prior art strain relief attachment for wire connector assembly 20 is shown. The attachment includes first and second attachments 88 and 88*a* respectively which include body member 89 which presents a common restraining edge 90 opposing the fixed restraining surface 80 of the central plate 36. Like the previously described prior art strain relief attachment, attachments 88 and 88*a* include end walls 92 and 92*a* to block longitudinal movement of the strain relief. Movement of the strain relief transverse to the longitudinal axis as shown in FIG. 3 is provided by latching members 94 which include a latching arm 96 extending across and engaging latch 98*a*.

Like the previously discussed prior art embodiment, the strain relief attachment includes a wall member 100 having a bottom edge 102 which abuts surface 54*a* and is provided with an inwardly projecting flange (not shown) extending along the bottom edge 102 and received between the space defined between the surface 54*a* and the posts 34. Accordingly, movement of the strain relief perpendicular to the longitudinal direction shown in FIG. 4 is prevented. Unlike the embodiment discussed with reference to FIGS. 1 and 2, the prior art embodiment of FIGS. 3 and 4 include flexible snaps 104 which have a locking surface 106 opposing the tabs 58 and 60 and disposed therefrom a distance equal to a thickness of a mounting bracket. The mounting bracket would be provided with an opening having a configuration sized to permit free passage of the strain relief on the wire attaching side but having a longitudinal length less than the longitudinal distance between flexible snaps 104. As the wire connector assembly 20 and the strain relief are passed through the opening, edges of the opening force the flexible snaps inwardly until the edge of the opening is passed at which point the snaps flex outwardly to the position shown in FIG. 4 and trap the mounting bracket in the space between the lock surface 106 and the tabs 58 and 60. A strain relief attachment as shown in FIGS. 3 and 4 is a commercially available item and may be as described in Catalog No. 73-152 revised 5/83 of the AMP Company and listed as Catalog Item No. 552962-1.

With each of the above-described embodiments, a plurality of wires are disposed within the slots 32 of the insulation displacement connectors 26 and extend in a direction axially aligned with the slots and are collected to form a composite cable 107. The common restraining edges (edge 74 in FIG. 1 and edge 90 in FIG. 3) restrain movement of the wires out of their respective slots and insures that any bending of the wires in a direction transverse to the longitudinal direction of the wire connector assembly 20 occurs adjacent the restraining edges at a point spaced above the wire connectors 26 to thereby insure that bending takes place in portions of the wire surrounded by insulation with a large bending radius and thereby avoid cold work failure of the wire.

As previously discussed in this application, such prior art strain relief attachments are still susceptible to loss of wires due to failure of the wire. Also, with such devices there is the possibility that foreign conductive material can migrate to the insulation displacement connectors 26 and cause a short across two or more of the conductive connector members 38. Also, such prior art strain relief together with the wire connector assembly 20 do not provide an extremely secure means for catching the complete wire connector assembly and strain relief attachments to a mounting bracket.

With reference now to FIGS. 5 through 12, a strain relief attachment according to the present invention will be described. The strain relief attachment includes a first attachment 108 and a second attachment 108*a*. The attachments include a body member 110 having transverse restraining means for restraining movement of wires transverse to their linear alignment. The transverse restraining means is in the form of a plurality of individual discrete restraining edges 112. Protruding from the body member and separating edges 112 are a plurality of individual restraining members 114. The restraining edges 112 and individual restraining members 114 have displacement structure which will be described more fully.

With particular reference to FIG. 5, the attachment 108 includes a wall 116 which extends perpendicular to the body member 110 and is provided with a lower edge 118 sized to rest upon edge 54*a*. The attachment 108 is provided with end walls 120 and 122 disposed on longitudinally opposite ends of the attachment 108 and each provided with a notch 124, 126, respectively, sized to receive end walls 66 and 68 of central plate 36. The attachment 108 includes a flange 128 (seen best with reference to flange 128*a* of attachment 108*a* in FIG. 5) extending from bottom edge 118 and projecting parallel to body member 110 with the flange 128 sized to be received within space defined between surface 54*a* and posts 34 of the wire connector assembly 20. The flange 128 has a center portion 130 having an increased thickness sized to be substantially equal to the distance between the posts 34 and the surface 54*a*. The attachment include a latch element 132 and a mating element 134 disposed on end walls 120 and 122, respectively.

Shown best in FIGS. 5 and 8, the mating element 134 includes a cam surface 136 disposed between opposing walls 138 and 140 projecting in the plane generally parallel to the longitudinal direction of the attachment with the cam surface extending generally transverse to the longitudinal direction. The cam surface 136 has a slope extending from a free edge 142 to a maximum displacement end 144. An arcuate detent 146 is formed in the mating element 134 at the maximum displacement end 144.

The latching element includes an extending arm 148 sized to extend between the opposing walls 138 and 140 and having a longitudinal dimension sized to extend to an opposing mating element when the first and second attachments are secured to the assembly 20. The extending arm 148 terminates at an end having a cam follower 150 with an arcuate surface 152 sized to mate with arcuate detent 146. The cam follower is sized to yieldably engage the cam surface 136 and be releaseably received within detent 146. A slot 153 (shown in FIG. 8) is provided on the mating element 134 and positioned to received a tool (such as a small screwdriver or the like) and direct the tool to engage the cam follower 150 within the detent 146 and urge the cam follower out of the detent.

With the first and second attachments 108 and 108*a* received on the wire connector assembly 20, the attachments are secured together by opposing latching and mating elements 132, 134*a* and 132*a* and 134 preventing the attachments to be pulled away from one another in a direction transverse to their longitudinal direction. Walls 66 and 68 are received within notches 124 and 126 and thereby restrain movement of the attachments in a direction parallel to the longitudinal direction of the wire connector assembly 20. Finally, the enlarged central portion 130 of inwardly projecting flange 128 received between posts 34 and surface 54*a* prevents movement of the strain relief attachments in a direction perpendicular to the longitudinal direction of the wire connector assembly 20 as shown in FIG. 12.

The wall 116 and body member 110 are sized such that the restraining edges 112 oppose the fixed restraining surface 80 with the edges 112 abutting wires axially extending from slots 32. The plurality of individual restraining members 114 extend from the restraining edges 112 toward the fixed restraining surface 80. Opposing individual restraining members 114 and edges 112 define a plurality of passages exposing the slots 32 through which individual insulated wires pass. The individual restraining members 114 in the forms of tabs, are spaced apart a distance approximately equal to the diameter of an insulated wire. The restraining members 114 and restraining edges 112 are positioned spaced above the insulation displacement connector 26. A wire extending through the passages defined by the restraining edges 112 and the individual restraining members 114 can only be bent by bending the wire at its position opposing edges 112 and individual restraining members 114. As a result, the wire cannot be worked at its point of contact with insulation piercing members 48 and 48*a* thereby avoiding failure of the wire due to cold working at this point. As shown in the drawings, the individual restraining members extending from restraining edges 112 provide the body member 110 with a comb-like appearance which organizes the plurality of wires in a fanned-out arrangement. Also, with the wires extending through the passages defined by opposing individual restraining members 114, the restraining members and the wires block access to the insulation displacement connectors 26. Accordingly, foreign material is blocked from migrating to the insulation displacement connectors 26 where the material could possibly cause a short across two or more of the connectors 26.

As shown best in FIGS. 5 and 12, the strain relief attachments 108 are provided with a plurality of lock members 160 disposed on wall 116. Each of the lock members comprises a protruding portion of the wall 116 and has a hinged end 164 adjacent the juncture of wall 116 and restraining member 110. The lock members ramp outwardly to a locking end 166 which extends beyond wall 116 on a side thereof opposite flange 128. The lock members terminate at a lock surface 168 which is spaced from edge 118 by a predetermined distance. The lock members 160 are flexible and may be urged toward the central plate 36 by applying a force on the locking ends 166 urging the members 160 inwardly with the members pivoting around the hinged ends 164. The attachments 108 and 108*a* are formed of a suitable non-conductive material which is generally rigid but permits relative flexing of the lock members 160. A preferred material would be a polycarbonate such as LEXAN 940 as supplied by the General Electric Company.

Referring now to FIGS. 9 through 12, a wire connector assembly 20 having first and second strain relief attachments 108 and 108*a* is shown secured within a mounting bracket 170. As shown in FIG. 9, it is intended that such connector assemblies may be installed within a bracket which provides for a plurality of assemblies in side by side relation. However, a bracket could consist of only one assembly or as many assemblies as a designer may prefer. In the view of FIG. 9, there are three wire connector assemblies 20 to be mounted into bracket 170. All of the wire connector assemblies are alike and similar parts are numbered identically.

As shown in FIGS. 9 and 10, the bracket includes an opening 172 extending from a first surface 174 to a second surface 176 as best shown in FIG. 10. As shown in FIG. 9, the edge 178 of opening 172 is contoured to define opening 172 such that the strain relief attachments and the wire attaching side 22 of the wire connector assemblies 20 (not including locks 160) may freely pass through the opening 172 when the wire connector assemblies 20 are aligned with their longitudinal direction aligned with the longitudinal direction of the opening 172. Longitudinal ends of the opening 172 are provided with notches 180 and 182 sized to receive longitudinally extending tabs 58 and 60 of the wire connector assembly 20. However, no relief is made within the mounting bracket 170 to provide passage for the wings 62 and 64 when the wire connector assembly 20 is aligned as shown in the center connector assembly 20 of FIG. 9. In such circumstance, the upper surfaces 62*a* and 64*a* of the wings 62 and 64 are mounting surfaces which oppose second surface 176 of bracket 170 in blocking relationship.

Best shown in the far right-hand opening 172 of FIG. 9, (and as shown in cross section in FIGS. 11 and 12) the mounting bracket 170 at surface 176 is provided with a plurality of reduced thickness portions 186 and 186*a* which are aligned with locking members 160 and 160*a*, respectively, when the wire connector assembly 20 is oriented in a position with its longitudinal axis aligned with the longitudinal axis of the opening 172. The reduced thickness portions have thicknesses equal to the distance between locking surface 168 and 168*a* of the lock members and the surfaces 54*a* and 56*a* or edges 118, 118*a*. Accordingly, when the wire connector assembly 20 is longitudinally aligned with an opening 172 and the wire attaching side is passed through the opening 172, the opening defining edges 178 of bracket 170 engage the locking members 160 forcing them inwardly until the locking members have passed the reduced thickness portions at which point the locking members snap outwardly and the wire connector assembly 20 and the strain relief attachments are securely captured on bracket 170.

Shown in the far right-hand opening of FIG. 9, the openings 172 are provided with reliefs 185 and 185*a* disposed on opposing longitudinal edges 178. The reliefs 185 and 185*a* which are aligned on opposite sides of opening 172 are provided with a distance between the edges 178 at the reliefs 185 and 185*a* being greater than a distance fully protruding lock members 160 and 160*a* on first attachment 108 and second attachment 108*a*.

With a bracket 170 and a wire connector assembly 20 with first strain relief member 108 and second strain relief member 108*a*, wires can be installed within the connector assembly 20 and the connector assembly can be installed in the mounting bracket 170 in the following manner. Individual insulation bearing conductive wires are inserted into the slots 32 with the wires axially aligned within the slots. The wires are urged past the insulation piercing members 48 and 48*a*. As the wires are urged to pass the members, the insulation piercing members 48 and 48*a* slice through the insulation 50 and engage the conductive wire 52 in good mechanical and electrical contact. With all of the wires so installed within the slots 32, the first and second attachments are secured to the wire connector assembly 20 with individual wires received singularly within individual passages defined by opposing individual restraining paths 114 and the restraining edges 112. In this manner, the comb-like restraint fans out the wires and maintains them in orderly positioning. The individual wires are then collected and secured to form a composite cable 107. The assembly 20 with its wires and attached strain relief attachments is oriented with its longitudinal axis generally perpendicular to the longitudinal axis of the opening 172 (as shown in the far right-hand of FIG. 9) with the lock members 160 and 160*a* on opposite attaching members aligned with reliefs 185 and 185*a*. So aligned, the assembly 20 is passed completely through the opening 172 and reoriented with its longitudinal dimension parallel aligned with a longitudinal dimension of the opening 172. So aligned, the wire attaching side 82 of the wire connector assembly 20 is passed through the opening with the edges 178 of the opening 172 engaging the lock members 160 and 160*a* and urging them inwardly. As the lock members pass the second surface 176 of the mounting bracket 170, the lock members spring outwardly, engaging adjacent reduced portions 186, 186*a*, and trap the mounting bracket between the lock members and the locking surfaces.

In addition to having all the benefits previously described in connection with the comb-like appearance of the restraining members, the spaced apart pair of locking members of individual strain relief attachments provides for a solid means for attaching a wire connector assembly 20 to a bracket 170 without significant rocking of the assembly 20 about its longitudinal axis.

The foregoing description of wire connector assemblies 20 mounted in bracket 170 described the bracket 170 as having reduced thickness portions 186 and 186*a* aligned with locking members 160 and 160*a*. This is preferred where the bracket 170 is made of conductive synthetic plastic material. In such cases, the strength of the material requires the bracket 170 be formed with a material thickness greater than the spacing between locking surfaces 168 and 168*a* and surfaces 54*a* and 56*a*. An alternative to this is to form the bracket 170 of uniform thickness high strength material such as sheet metal which has been stamped to prosent an opening 172 having an outline defined by edge 178. In this case, there would be no reduced thickness portions and the entire bracket 170 would have the thickness of portions 186 and 186*a*.

From the foregoing, it can be seen how the present invention through novel structure provides numerous benefits not previously enjoyed by the art. While the foregoing describes the present invention in a preferred embodiment, it will be appreciated that it is not intended to so limit the scope of the invention and that such scope shall be limited only by the scope of the claims as are appended hereto.

What is claimed is:

1. An electrical connector assembly comprising: a wire attaching side including a plurality of insulation displacement connectors each having a wire receiving slot sized to receive an insulation bearing conductive wire of predetermined size within said slot, each of said connectors further having electrically conductive insulation piercing members projecting into said slots and sized to pierce insulation of a wire received within said slot and conductively engage said wire;

said plurality of connectors arranged in first and second sets with axes of slots within a set parallel and linearly aligned to hold a plurality of wires within said slots with axes of said wires disposed within said slots parallel and linearly aligned;

said first and second sets disposed in parallel aligned spaced apart relation;

a pair of strain relief attachments for restraining wires held by said connectors;

means for securing said strain relief attachments to said assembly with said attachments providing strain relief for wires held by said connector;

said assembly presenting a mounting surface sized to abut a first surface of a mounting bracket having an opening sized for said wire attaching side to extend through said opening with said mounting surface abutting said first surface;

said attachments each having locking members on sides thereof to protrude beyond said opening and presenting a locking surface opposing a second surface of said mounting bracket, said locking surface disposed in a plane spaced from said mounting surface a distance approximate to a distance between said first surface and said second surface; said locking member disposed for said mounting bracket to be captured between said lock surface and said mounting surface when said assembly is disposed with said wire attaching side extending through said opening and said mounting surface abutting said first surface; and said lock members flexible to be urged toward said wire receiving side.

2. An electrical connector assembly according to claim 1 wherein said second and second attachments are each provided with a plurality of individual restraining members secured to said body members and extending between said insulation displacement conductors.

3. An electrical connector assembly according to claim 1 comprising a mounting bracket having an opening formed therethrough sized for said wire receiving end and said second and second attachments secured to said assembly to pass through said opening with a longitudinal axis of said assembly aligned with a longitudinal axis of said opening and with opposing surfaces of said lock members and opening defining edge of said bracket engaging each other with said edge urging said lock members toward said wire receiving side as said side passes through said opening; said opening further sized to present a first surface disposed in blocking arrangement to said mounting surface as said assembly is passed into said opening with said longitudinal axes aligned.

4. An electrical connector assembly according to claim 3 wherein said opening defining edges of said bracket are provided with reliefs formed therein and aligned to provide free passage of said lock members therethrough with said assembly aligned with a longitudinal axis generally normal to a longitudinal axis of said opening.

5. A method of installing an electrical connector assembly into a mounting bracket wherein said connector includes a wire attaching side having a plurality of insulation displacement connectors each having a wire receiving slot sized to receive an insulation bearing conductive wire of predetermined size within said slot; each of said connectors having electrically conductive insulation piercing members projecting into said slots and sized to pierce insulation of a wire received within said slot and conductively engage said wire;

said plurality of conductors arranged in first and second parallel aligned spaced apart sets with axes of slots within a set parallel and linearly aligned;

a pair of strain relief attachments including a first attachment and a second attachment;

means for securing said first and second attachments to said assembly with said attachments providing strain relief for wires held by said connector;

a mounting bracket having a first surface and an opposite second surface with an opening formed therethrough sized to provide for movement of said attachments and wire attaching side when said assembly is oriented with longitudinal axis aligned with a longitudinal axis of said opening and with a portion of said first surface opposing a mounting surface of said assembly in blocking engagement;

lock members protruding from sides of said attachments and opposing said second surface of said mounting bracket, said lock members presenting a locking surface disposed in a plane spaced from said mounting surface a distance approximate to a distance between said first and second surfaces of said mounting bracket;

reliefs formed within opening defining edges of said mounting bracket and aligned to provide free movement of said lock members therethrough when said assembly is oriented with a longitudinal axis generally normal to a longitudinal axis of said opening;

the method comprising the steps of:

inserting insulation bearing conductive wires into said slots with said wires axially aligned with said slots and urging said wires past said insulation piercing members with said members piercing said insulation and conductively engaging said wires;

securing said first and second attachments to said assembly;

positioning said assembly and wires extending therefrom opposing said second surface of said mounting bracket with said assembly oriented with a longitudinal axis normal to a longitudinal axis of said opening;

aligning said lock members with said reliefs;

passing said assembly through said opening with said lock members passing through said reliefs;

reorienting said assembly to a position with said longitudinal axis of said assembly aligned with said opening longitudinal axis and with said wire attaching side opposing said opening;

passing said wire receiving side through said opening with edges of said opening engaging said lock members and urging them toward said wire receiving side; and continuing to pass said wire receiving side through said opening until said mounting surface abuts said first surface of said mounting bracket and said lock members pass said opening and protrude said second surface.

* * * * *

UNITED STATES PATENT AND TRADEMARK OFFICE

CERTIFICATE OF CORRECTION

PATENT NO. : 4,679,880

DATED : July 14, 1987

INVENTOR(S) : Daniel M. Pitsch

It is certified that error appears in the above-identified patent and that said Letters Patent is hereby corrected as shown below:

Column 11, line 17, "said second and second attachments" should be --said attachments--; and Column 11, line 25, "said second and second attachments" should be --said attachments--.

Signed and Sealed this

Third Day of November, 1987

*Attest:*

*Attesting Officer*

DONALD J. QUIGG

*Commissioner of Patents and Trademarks*